US009217573B2

(12) United States Patent
Jung et al.

(10) Patent No.: US 9,217,573 B2
(45) Date of Patent: Dec. 22, 2015

(54) COOK TOP UNIT FOR COOKER

(71) Applicant: LG ELECTRONICS INC., Seoul (KR)

(72) Inventors: Euisu Jung, Changwon-si (KR); Byoungwoo Choi, Changwon-si (KR); Dongwan Lim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 348 days.

(21) Appl. No.: 13/662,081

(22) Filed: Oct. 26, 2012

(65) Prior Publication Data

US 2013/0104874 A1 May 2, 2013

(30) Foreign Application Priority Data

Nov. 1, 2011 (KR) ..... 10-2011-0112644

(51) Int. Cl.
*F24C 15/10* (2006.01)
*F24C 3/00* (2006.01)

(52) U.S. Cl.
CPC . *F24C 15/10* (2013.01); *F24C 3/00* (2013.01); *F24C 3/002* (2013.01)

(58) Field of Classification Search
CPC ..... F24C 15/08; F24C 3/00; F24C 3/14; F24C 15/10
USPC ..... 126/211
See application file for complete search history.

(56) References Cited

U.S. PATENT DOCUMENTS 4,886,042 A * 12/1989 Bessler ..... 126/21 R
2002/0153001 A1* 10/2002 Hunault et al. ..... 126/39 R

FOREIGN PATENT DOCUMENTS

JP 63-161546 U 7/1988
JP 2005-003288 A 1/2005
KR 10-0737453 B1 7/2007
KR 100737453 B1 * 7/2007

* cited by examiner

*Primary Examiner* — Avinash Savani
*Assistant Examiner* — Aaron Heyamoto
(74) *Attorney, Agent, or Firm* — Birch, Stewart, Kolasch & Birch, LLP

(57) ABSTRACT

Provided is a cook top unit of a cooker. The cook top unit for a cooker includes a top frame, a bracket, and at least one heating source. The top frame includes a top surface part and a rear surface part extending at a predetermined angle with respect to the top surface part. The bracket is fixed to a rear end of each lateral side of the top frame. The heating source is disposed at the top frame. At least a portion of the rear surface part is inserted in the bracket. Therefore, when the cooker is installed or used, the top frame may not be deformed, and an enamel coating layer on the top frame may not be damaged.

8 Claims, 7 Drawing Sheets

COOK TOP UNIT FOR COOKER

CROSS-REFERENCE TO RELATED APPLICATIONS

The present application claims priority under 35 U.S.C. 119 and 35 U.S.C. 365 to Korean Patent Application No. 10-2011-0112644 (filed on Nov. 1, 2011), which is hereby incorporated by reference in its entirety.

BACKGROUND

The present disclosure relates to a cooker.

Cookers are devices for cooking food using gas or electricity. Such a cooker includes a cook top unit which is usually disposed on an upper surface of the cooker. Various heating sources may be provided at the cook top unit for cooking food.

FIG. 1 is an exploded perspective view illustrating a cook top unit 10 of a cooker of the related art.

Referring to FIG. 1, the cook top unit 10 includes a top frame 20, a top plate 30, a plurality of heating sources 300, and brackets 50. Substantially, the top frame 20 is fixed to the top of a cabinet (not shown) that forms the exterior of the cooker. The top plate 30 is placed on the top of the top frame 20. The respectively heating sources 300 are supported by the top frame 20.

In more detail, the top frame 20 includes a top surface part 21 and a rear surface part 25. The top surface part has an approximately rectangular plate shape. The rear surface part 25 extends from the rear end of the top surface part 21 at right or any other preset angle with the top surface part 21 so that the rear surface part 25 can be sloped rearward and upward. Substantially, the top surface part 21 and the rear surface part 25 may be formed in one piece. In the case, the rear surface part 25 may be bent upward from the top surface part 21.

A plate receiving recess 22 is formed in the top surface part 21. The plate receiving recess 22 is formed by making the top surface of the top surface part 21 concave downward except for the edges of the top surface of the top surface part 21. Substantially, the top plate 30 is placed in the plate receiving recess 22.

A plurality of installation openings 23 are formed in the top surface part 21. The heating sources 300 are disposed in the installation openings 23. The installation openings 23 may be formed by cutting portions of the top surface part 21 into predetermined shapes and sizes.

A container in which food is contained may be placed on the top plate 30, and heat may be transferred from one of the heating sources 300 to the container through the top plate 30. For example, the top plate 30 may be formed of ceramic glass.

The heating sources 300 are disposed in the installation openings 23. The heating sources 300 may be electric heaters such as radiation heaters or induction heaters.

The brackets 50 enhance the strength of the top frame 20. Substantially, the brackets 50 prevent deformation of the rear surface part 25 relative to the top surface part 21. For this, the brackets 50 are fixed to both lateral sides of the rear end of the top frame 20.

The brackets 50 have an approximately L-shape. Edges of upper and front ends of the brackets 50 are in contact with the bottom and rear surfaces of the top frame 20. Substantially, the edges of the upper and front ends of the brackets 50 are in contact with the bottom surface of the top surface part 21 and the rear surface of the rear surface part 25. In this state, the brackets 50 are fixed by welding.

However, the cooker of the related art has the following limitations.

In the related art, the brackets 50 are fixed to the bottom and rear surfaces of the top frame 20 by welding. Therefore, the top frame 20 and the brackets 50 may be kept in a fixed state even when the rear surface part 25 is pushed backward. However, if the top frame 20 is pulled forward, the top frame 20, that is, the rear surface part 25 may be separated from the brackets 50. Thus, the rear surface part 25 may be moved relative to the top surface part 21, and in this case, an enamel coating on the top and front surfaces of the top frame 20 may be damaged.

SUMMARY

Embodiments provide a more durable cook top unit for a cooker.

In one embodiment, there is provided a cook top unit for a cooker, the cook top unit including: a top frame including a top surface part and a rear surface part extending at a predetermined angle with respect to the top surface part; a bracket fixed to a rear end of each lateral side of the top frame; and at least one heating source disposed at the top frame, wherein at least a portion of the rear surface part is inserted in the bracket.

In another embodiment, there is provided a cook top unit for a cooker, the cook top unit including: a top frame including a top surface part and a rear surface part extending at a predetermined angle with respect to the top surface part; a bracket including a body part and first and second contact parts, the body part having a shape corresponding to vertical sections of the top surface part and the rear surface part of the top frame, the first and second contact parts being disposed on the body part for making surface contact with a lower surface of the top surface part and a rear surface of the rear surface part, respectively; and at least one heating source disposed at the top frame, wherein the rear surface part includes: a first extension extending rearward from an upper end of the rear surface part at a predetermined angle; and a second extension extending downward from a rear end of the first extension at a predetermined angle, wherein the bracket further includes an insertion slot formed by cutting a portion of the body part to receive the second extension.

In further another embodiment, there is provided a cook top unit for a cooker, the cook top unit including: a top frame including a top surface part and a rear surface part extending at a predetermined angle with respect to the top surface part; a bracket fixed to a rear end of each lateral side of the top frame for preventing the rear surface part from deforming relatively to the top surface part; and at least one heating source disposed at the top frame, wherein the top surface part and the bracket are fixedly welded to each other in a state where a portion of the bracket makes contact with a lower surface of the top surface part, and the rear surface part and the bracket are fixed to each other by inserting a portion of the rear surface part in the bracket.

The details of one or more embodiments are set forth in the accompanying drawings and the description below. Other features will be apparent from the description and drawings, and from the claims.

DETAILED DESCRIPTION OF THE EMBODIMENTS

Hereinafter, an explanation will be given of a cook top unit of a cooker according to exemplary embodiments with reference to the accompanying drawings.

Figure 1:
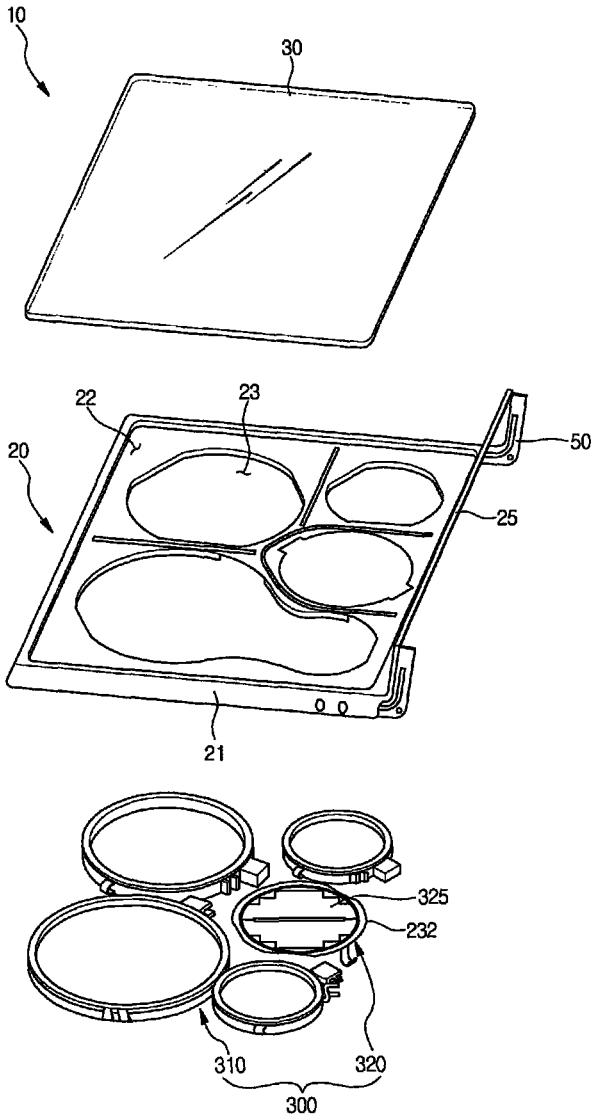
FIG.1 Prior Art
FIG. 1 is an exploded perspective view illustrating a cook top unit of a cooker of the related art.
Figure 2:
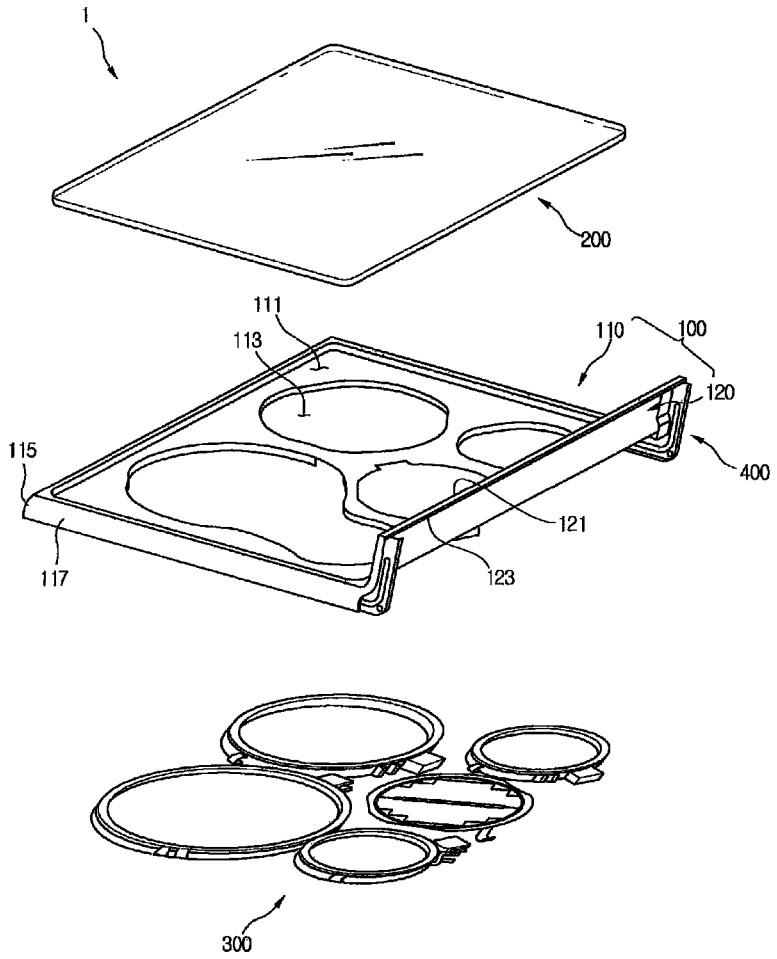
FIG. 2 is a perspective view illustrating main parts of a cook top unit of a cooker according to a first embodiment.
Figure 3:
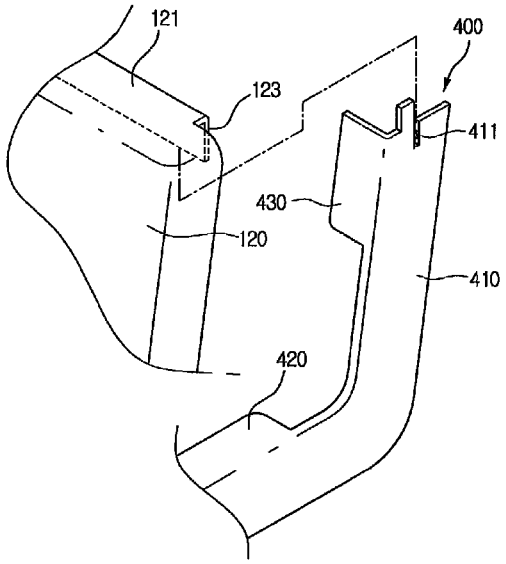
FIG. 3 is an exploded perspective view illustrating main parts of the cook top unit of the first embodiment.
Figure 4:
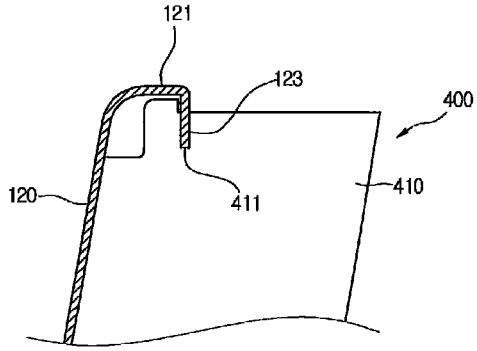
FIG. 4 is a vertical sectional view illustrating main parts of the cook top unit of the first embodiment.

FIG. 2 is a perspective view illustrating main parts of a cook top unit 1 of a cooker according to a first embodiment; FIG. 3 is an exploded perspective view illustrating main parts of the cook top unit 1 of the first embodiment; and FIG. 4 is a vertical sectional view illustrating main parts of the cook top unit 1 of the first embodiment.

Referring to FIG. 2, a top frame 100 of the cook top unit 1 includes an top surface part 110 and a rear surface part 120. The top surface part 110 has a rectangular shape and predetermined size. The rear surface part 120 extends from the rear end of the top surface part 110 at right or any other preset angle with the top surface part 110 so that the rear surface part 120 can be sloped rearward and upward. Substantially, the top surface part 110 and the rear surface part 120 may be formed by bending a portion of a member from the other portion of the member. An enamel coating layer is formed on the top surface of the top surface part 110 and the front surface of the rear surface part 120. The enamel coating layer increases the heat resistance of the top frame 100 and makes it easy to clean the top frame 100.

A plate receiving recess 111 (described later) is formed in the top surface part 110 to receive a top plate 200 (described later). A plurality of installation openings 113 are formed in the top surface part 110 for placing electric heaters 300 (described later) therein.

A front deco 115 is provided on the front end of the top surface part 110, and side decos 117 are provided on both lateral side ends of the top surface part 110. The front deco 115 and the side decos 117 extend downward from the front and lateral side ends of the top surface part 110.

Referring to FIGS. 3 and 4, a first extension 121 is provided on the upper end of the rear surface part 120. The first extension 121 extends backward from the upper end of the rear surface part 120. Substantially, the first extension 121 may be formed by bending an upper portion of the rear surface part 120 from the other portion of the rear surface part 120.

A second extension 123 is provided on both lateral side ends of the first extension 121. The second extension 123 extends downward from the rear end of the first extension 121 at right or any other preset angle with the first extension 121. Substantially, the second extension 123 may be formed by bending both lateral side ends of the first extension 121 from the other portion of the rear surface part 121.

Referring again to FIG. 2, the top plate 200 is placed on the top surface of the top frame 100. The electric heaters 300 are disposed in the installation openings 113. The top plate 200 and the electric heaters 300 have substantially the same structures as those of the related art.

Brackets 400 are fixed to the rear ends of both lateral sides of the top frame 100. The brackets 400 prevent bending of the top frame 100. Substantially, owing to the brackets 400, the rear surface part 120 may not be bent relative to the top surface part 110. Referring to FIGS. 3 and 4, each of the brackets 400 includes a body part 410 and first and second contact parts 420 and 430.

In more detail, the body part 410 has an approximately L-shape. The shape of the body part 410 corresponds to the cross sectional shape of the top surface part 110 and the rear surface part 120.

The first contact part 420 horizontal extends from an upper end of the body part 410. The second contact part 430 horizontal extends from a front end of the body part 410. The first and second contact parts 420 and 430 make contact with the bottom and rear surfaces of the top frame 100. That is, the first and second contact parts 420 and 430 make contact with the bottom surface of the top surface part 110 and the rear surface of the rear surface part 120. Substantially, the first and second contact parts 420 and 430 may be discontinuously disposed on the upper and front ends of the body part 410. The first contact part 420 is fixed to the bottom surface of the top surface part 110 by welding. However, the second contact part 430 that makes surface contact with the rear surface of the rear surface part 120 is not welded to the rear surface of the rear surface part 120.

In the current embodiment, an insertion slot 411 is formed in an upper end of the body part 410. The insertion slot 411 is formed by vertically cutting off a portion of the upper end of the body part 410 so that the insertion slot 411 can have a predetermined length. A portion of the rear surface part 120 is inserted in the insertion slot 411. That is, the second extension 123 is inserted in the insertion slot 411.

In the current embodiment, since the second extension 123 is inserted in the insertion slot 411, the brackets 400 can hold the rear surface part 120 when the rear surface part 120 is pulled forward as well as when the rear surface part 120 is pushed backward. Therefore, the top frame 100 may not be deformed or the enamel coating layer may not be damaged although the rear surface part 120 is pulled forward to deform the rear surface part 120 relative to the top surface part 110.

In the current embodiment, as described above, only the first contact part 420 is welded to the bottom surface of the top surface part 110. Therefore, the top frame 100 and the brackets 400 can be easily fixed.

Hereinafter, an explanation will be given of a cook top unit 2 of a cooker according to a second embodiment with reference to the accompanying drawings.

Figure 5:
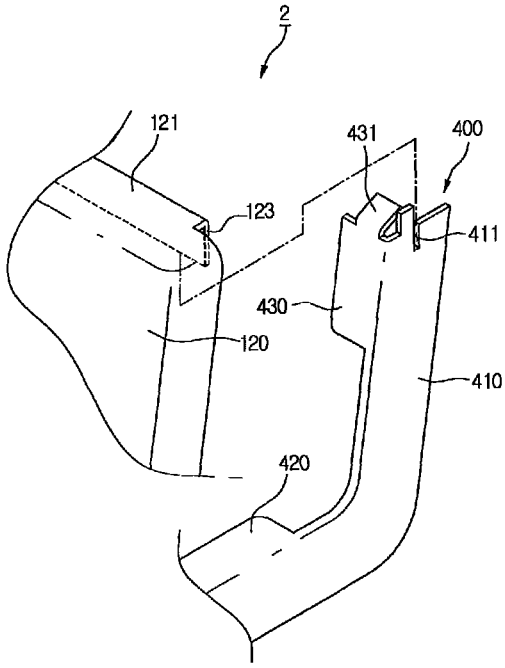
FIG. 5 is a perspective view illustrating main parts of a cook top unit of a cooker according to a second embodiment.
Figure 6:
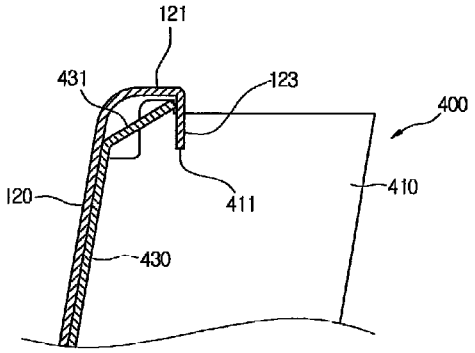
FIG. 6 is a vertical sectional view illustrating main parts of the cook top unit of the second embodiment.

FIG. 5 is a perspective view illustrating main parts of the cook top unit 2 of a cooker according to the second embodiment, and FIG. 6 is a vertical sectional view illustrating main parts of the cook top unit 2 of the second embodiment. In the description of the current embodiment, the same elements as those of the first embodiment are denoted by the same reference numerals used in FIGS. 2 to 4, and thus detailed descriptions of the same elements are not repeated.

Referring to FIGS. 5 and 6, in the cook top unit 2 of a cooker of the current embodiment, a sloped extension 431 is provided on the upper end of the second contact part 430. The sloped extension 431 extends backward and upward from the upper end of the second contact part 430 at a predetermined angle. The angle between the sloped extension 431 and the first contact part 420 is different from the angle between the first contact part 420 and the second contact part 430. Substantially, the angle between the sloped extension 431 and the first contact part 420 is smaller than the angle between the first contact part 420 and the second contact part 430. Therefore, the sloped extension 431 may not make surface contact with the rear surface of the rear surface part 120 but make line contact with the rear surface of the rear surface part 120.

In more detail, the leading end of the sloped extension 431 is placed in a space defined by the rear surface part 120 and the first and second extensions 121 and 123 in a state where the first and second contact parts 420 and 430 are in surface contact with the bottom and rear surfaces of the top frame 100 (that is, in a state where the first and second contact parts 420 and 430 are in surface contact with the bottom surface of the top surface part 110 and the rear surface of the rear surface part 120). In addition, the leading end of the sloped extension 431 may make line contact with one of the first and second extensions 121 and 123 or the edge between the first and second extensions 121 and 123. Therefore, according to the current embodiment, since the second extension 123 is inserted in the insertion slot 411 and the leading end of the sloped extension 431 is in line contact with one of the first and second extensions 121 and 123 or the edge between the first and second extensions 121 and 123, the brackets 400 can hold the rear surface part 120 when the rear surface part 120 is pulled forward.

Hereinafter, an explanation will be given of a cook top unit of a cooker according to a third embodiment with reference to the accompanying drawing.

Figure 7:
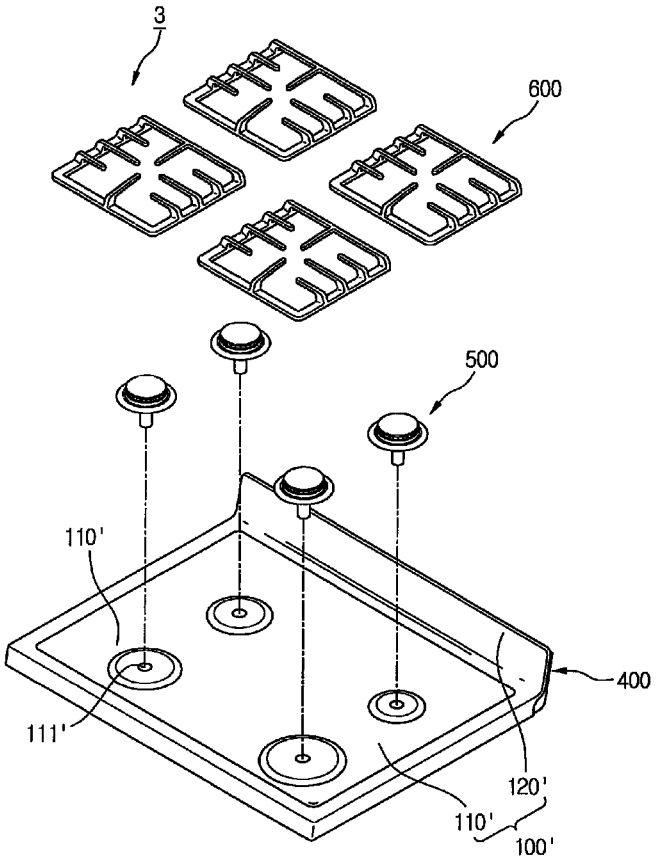
FIG. 7 is a perspective view illustrating main parts of a cook top unit of a cooker according to a third embodiment.

FIG. 7 is a perspective view illustrating main parts of the cook top unit of a cooker according to the third embodiment.

Referring to FIG. 7, in the cook top unit of a cooker of the current embodiment, a top frame 100' includes a top surface part 110' and a rear surface part 120'. The top surface part 110' and the rear surface part 120' are similar to those of the first and second embodiments. However, according to the current embodiment, grates 600 and heating sources such as gas burners 500 are disposed on the top surface of the top frame 100' (that is, the top surface of the top surface part 110'). An object can be placed on any of the grates 600 to heat the object using the gas burners 500. Therefore, according to the current embodiment, the top plate 200 used in the first and second embodiments may not be used. In addition, according to the current embodiment, the plate receiving recess 111 and the installation openings 113 of the first and second embodiments may not be formed. Instead, penetration holes 111' may be formed in the top frame 100' (substantially, in the top surface part 110') to place gas tubes in the penetration holes 111' and supply gas to the gas burners 500 through the gas tubes.

In addition, brackets 400 are fixed to the rear ends of both lateral sides of the top frame 100. The brackets 400 may be fixed to the top frame 100' in the same manner as in one of the first and second embodiments.

According to the embodiments, the top frame and the bracket are fixed to each other so that the top frame and the bracket can resist a forwardly pulling force. Therefore, when a cooker is installed or used, the top frame may not be deformed, and the enamel coating layer of the top frame may not be damaged.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cook top unit for a cooker, comprising:

a top frame comprising a top surface part and a rear surface part extending at a predetermined angle with respect to the top surface part;

a bracket comprising a body part and first and second contact parts extending perpendicularly from the body part toward the top surface part, the body part having a shape corresponding to vertical sections of the top surface part and the rear surface part of the top frame, the first and second contact parts being disposed on the body part for making surface contact with a lower surface of the top surface part and a rear surface of the rear surface part, respectively; and at least one heating source disposed at the top frame, wherein the rear surface part comprises:

a first extension extending rearward from an upper end of the rear surface part at a predetermined angle; and a second extension extending downward from a rear end of the first extension at a predetermined angle, wherein the bracket further comprises:

an insertion slot formed by cutting a portion of the body part to receive the second extension; and a sloped extension extending from an upper end of the second contact part toward a rear end of the bracket, wherein the sloped extension is selectively brought into line contact with the second extension and the connection portion between the first and second extensions by a force applied to the rear surface part.

2. The cook top unit according to claim 1, wherein the first contact part is welded to the lower surface of the top surface part.

3. The cook top unit according to claim 1, wherein a leading end of the sloped extension is located in a space defined by the rear surface part and the first and second extensions.

4. The cook top unit according to claim 1, wherein an angle between the sloped extension and the first contact part is smaller than an angle between the first contact part and the second contact part.

5. The cook top unit according to claim 1, wherein an installation opening is formed in the top frame;

the heating source is disposed in the installation opening; and heat is transferred from the heating source to a heating target object through a top plate placed on a top surface of the top surface part.

6. The cook top unit according to claim 1, wherein a penetration hole is formed in the top frame;

the heating source is disposed on a top surface of the top frame and receives gas through a gas tube inserted through the penetration hole; and the heating source heats a heating target object supported on a grate placed on the top surface of the top surface part.

7. A cook top unit for a cooker, comprising:

a top frame comprising a top surface part and a rear surface part extending at a predetermined angle with respect to the top surface part;

a bracket comprising a body part and first and second contact parts extending perpendicularly from the body part toward the top surface part, the bracket being fixed to a rear end of each lateral side of the top frame; and at least one heating source disposed at the top frame, wherein the rear surface part comprises:

a first extension extending backward from an upper end of the rear surface part at a predetermined angle; and a second extension extending downward from a rear end of the first extension at a predetermined angle, wherein the bracket comprises:

the first contact part making surface contact with the lower surface of the top surface part;

the second contact part making surface contact with a rear surface of the rear surface part; and an insertion slot to receive the second extension, wherein the second contact part comprises a sloped extension extending from an upper end of the second contact part toward a rear end of the bracket, wherein an angle between the sloped extension and the second contact part is smaller than an angle between the first contact part and the second contact part, and wherein a leading end of the sloped extension is located in a space defined by the rear surface part and the first and second extensions.

8. The cook top unit according to claim 7, wherein the sloped extension is in line contact with the second extension or a connection portion between the first and second extensions, or the sloped extension is selectively brought into line contact with the second extension and the connection portion between the first and second extensions by a force applied to the rear surface part.

* * * * *